US005203460A

United States Patent [19]

Deister et al.

[11] Patent Number: 5,203,460

[45] Date of Patent: Apr. 20, 1993

[54] TENSION CONTROL APPARATUS FOR VIBRATING SCREENS

[75] Inventors: E. Mark Deister, Fort Wayne; Dale A. Loshe, New Haven, both of Ind.

[73] Assignee: Deister Machine Co., Inc., Fort Wayne, Ind.

[21] Appl. No.: 861,641

[22] Filed: Apr. 1, 1992

[51] Int. Cl.[5] ..... B07B 1/49

[52] U.S. Cl. ..... 209/402; 209/403; 209/404

[58] Field of Search ..... 209/402, 400, 401, 403, 209/404

[56] References Cited

U.S. PATENT DOCUMENTS

| | | |
|---|---|---|
| 810,682 | 1/1906 | Shafer et al. . |
| 2,000,426 | 5/1935 | Symons . |
| 2,077,678 | 4/1937 | Delamater . |
| 2,334,707 | 11/1943 | Johnson . |
| 2,338,523 | 1/1944 | Lincoln . |
| 2,804,208 | 8/1957 | Hardefeld et al. . |
| 2,864,500 | 12/1958 | Miller . |
| 2,985,303 | 5/1961 | Wright . |
| 4,133,751 | 1/1979 | Stengel . |
| 4,137,157 | 1/1979 | Deiser et al. . |
| 4,140,630 | 2/1979 | Scarlett et al. . |
| 4,444,656 | 4/1984 | Nelson et al. . |
| 4,529,510 | 7/1985 | Johnson et al. . |
| 4,732,670 | 3/1988 | Nelson . |
| 4,906,352 | 3/1990 | Nelson . |

FOREIGN PATENT DOCUMENTS 0238455 9/1987 European Pat. Off. .

*Primary Examiner*—H. Grant Skaggs

*Attorney, Agent, or Firm*—Barnes & Thornburg

[57] ABSTRACT

A vibrating screen apparatus includes a frame and a screen having a first end coupled to an anchor beam which is rigidly coupled to the frame. The apparatus also includes a tension control assembly coupled to a second end of the screen for tensioning the screen to substantially a predetermined tension. The tension control assembly is rotatably coupled to the frame spaced apart from the anchor beam. The tension control assembly changes the tension of the screen upon rotation of the tension control assembly relative to the frame about an axis of rotation. The apparatus further includes an adjusting mechanism for moving the tension plate in a direction normal to the axis of rotation of the tension plate to compensate for nonuniform tension of the screen.

24 Claims, 2 Drawing Sheets

TENSION CONTROL APPARATUS FOR VIBRATING SCREENS

BACKGROUND AND SUMMARY OF INVENTION

The present invention relates to a tension control apparatus for vibrating screens. More particularly, the present invention relates to an improved tension control apparatus which provides a substantially uniform tension across the width of a vibrating screen.

Vibrating screen assemblies for separating particulate matter into various sizes are well known. Conventional vibrating screen assemblies include a generally rigid frame, a screen deck coupled to the frame, and a vibrating mechanism for vibrating the screen deck.

It is often difficult to adjust the tension of screens that form the screen deck. In order to facilitate adjustment of the tension of screens in conventional vibrating screen assemblies, various types of tension control mechanisms have been developed. For example, a first end screen is coupled to the frame and a second end of the screen is coupled to a tension plate. Stationary coil tension springs are coupled to the tension plate to draw the screen over a series of vibrating support bars arranged in an arc. As the screen becomes stretched, the coil tension springs automatically keep the tension in the screen substantially constant. This reduces whipping or flexing of the screen which can cause wire breakage. See, for example, U.S. Pat. Nos. 4,137,157 and 2,804,208.

It is also known to provide a rotatable tension adjustment apparatus rotatably coupled to the frame. The rotatable tension adjustment apparatus is typically coupled to one end of the screen to facilitate adjusting the tension of the screen. Tension of the screen is adjusted as the tension adjustment apparatus is rotated relative to the frame. See, for example, U.S. Pat. Nos. 2,000,426; 2,338,523; 4,529,510; 4,732,670; and 4,906,352.

The tension adjustment apparatus disclosed in U.S. Pat. No. 4,906,352 includes an anchor assembly coupled to one end of a screen and a rotatable tension assembly spaced apart from the anchor assembly coupled to another end of the screen. The rotatable tension assembly includes an elongated tube rotatably coupled between spaced apart side walls of a rigid frame. As the tube is rotated to adjust the tension of the screen, the tube can bend in the middle. Therefore, the tension of the screen adjacent the bent middle portion of tube is less than the tension of the screen near the rigid side walls of the frame. To compensate for the reduced tension in the middle portion of the screen, the apparatus disclosed in the '352 Patent includes a second tension adjustment mechanism coupled to the anchor assembly. The second tension adjustment mechanism includes a flexible channel attached to opposite side walls of the frame and a rigid beam which is also attached to opposite side walls of the frame. The channel engages a screen flange to couple the first end of the screen to the channel. The second tension adjustment mechanism also includes a plurality of brackets coupled to the rigid beam and a bolt coupled between each bracket and the channel. By tightening the selected bolts, an operator can bend a predetermined portion of the flexible channel of the anchor assembly to increase the tension on the screen adjacent the predetermined portion of the channel. In other words, an operator can bend the channel to match the bend in the rotating tube at the opposite end of the screen to compensate for the reduced tension in the bent portion of the tube. The second tension adjustment mechanism disclosed in the '352 patent is located near the middle of the frame spaced apart from an end edge. Therefore, access to the second adjustment mechanism disclosed in the '352 patent can be difficult.

The present invention is designed to provide an improved tension control apparatus for a vibrating screen. The present invention includes a rotatable tension plate for adjusting the tension of a screen and means for selectively and incrementally adjusting the relative rigidity of the tension plate at predetermined intervals along the width dimension of the screen to compensate for nonuniform tension of the screen. The adjusting means is provided to straighten the tension plate if the tension plate bends during tensioning of the screen to provide a substantially uniform tension across the width of the screen. Advantageously, by providing an adjusting apparatus coupled to the rotatable tension plate at the same end of the screen, the adjusting apparatus is easily accessible in vibrating the screen assemblies having one or two screens. In addition, instead of bending two beams to match each other, the present invention straightens the rotatable tension plate. Therefore, both ends of the screen are aligned in substantially straight lines. This reduces forces acting on the screen which may tend to weaken the screen.

According to the present invention, a vibrating screen apparatus includes a frame and a screen having a first end, a second end, and a width dimension, and an anchor beam rigidly coupled to the frame. The first end of the screen is coupled to the anchor beam. The apparatus also includes means for tensioning the screen to substantially a predetermined tension. The tensioning means is rotatably coupled to the frame spaced apart from the anchor beam. The second end of the screen is coupled to the tensioning means. The tensioning means changes the tension of the screen upon rotation of the tensioning means relative to the frame. The apparatus further includes means for selectively and incrementally adjusting the relative rigidity of the tensioning means at predetermined intervals along the width dimension of the screen to compensate for nonuniform tension of the screen. The adjusting means is coupled to the tensioning means.

According to one aspect of the present invention, the frame includes first and second side walls which are spaced apart by a predetermined distance. The tensioning means includes an elongated pipe rotatably coupled between the first and second side walls of the frame about an axis of rotation. A tension plate is coupled to the pipe and to the second end of the screen. The apparatus includes means for rotating the pipe and tension plate about the axis of rotation to move the second end of the screen relative to the frame to adjust the tension of the screen. The means for rotating the pipe and the tension plate illustratively includes a lever coupled to the pipe and means for rotating the lever relative to the frame. The means for rotating the lever is coupled between the lever and the frame.

According to another aspect of the present invention, the adjusting means includes means for moving the tension plate relative to the pipe in a direction normal to the axis of rotation of the tension plate to compensate for nonuniform tension of the screen. The moving means is coupled to the tension plate. The moving means includes a plurality of adjustable fasteners extending through the tension plate and the pipe at spaced apart intervals to permit adjustment of the position of the tension plate relative to the pipe adjacent each of the plurality of adjustable fasteners.

Each of the plurality of adjustable fasteners includes a bolt extending through the tension plate and the pipe at spaced apart intervals, a rubber tension spring coupled to the bolt, and a nut threadably coupled to the bolt to permit adjustment of the position of the tension plate relative to the pipe. Each of the plurality of adjustable fasteners also includes a spherical socket coupled to the bolt adjacent to the rubber tension spring. Each spherical socket includes a generally spherical concave surface and each of the rubber tension springs includes a generally spherical convex surface configured to engage the generally spherical concave surface of an adjacent spherical socket. The spherical socket and the spherical convex surface of the rubber tension spring provide a flush contact surface despite slight movement of the tension plate relative to the pipe. The resilient rubber tension springs maintain a predetermined tension on the screen even if the screen stretches during operation.

According to yet another aspect of the present invention, a face plate is coupled to the pipe opposite the tension plate. The face plate provides a flat surface to support the tension adjusting means. The spherical socket of the adjusting means abuts the face plate to facilitate movement of the tension plate. The face plate is formed to include a plurality of notches to prevent particulate matter from becoming trapped between the tension plate and the face plate.

Other objects, advantages and novel features of the present invention will become apparent from the following detailed description of the invention when considered in conjunction with the accompanying drawings.

DETAILED DESCRIPTION OF THE DRAWINGS

Figure 1:
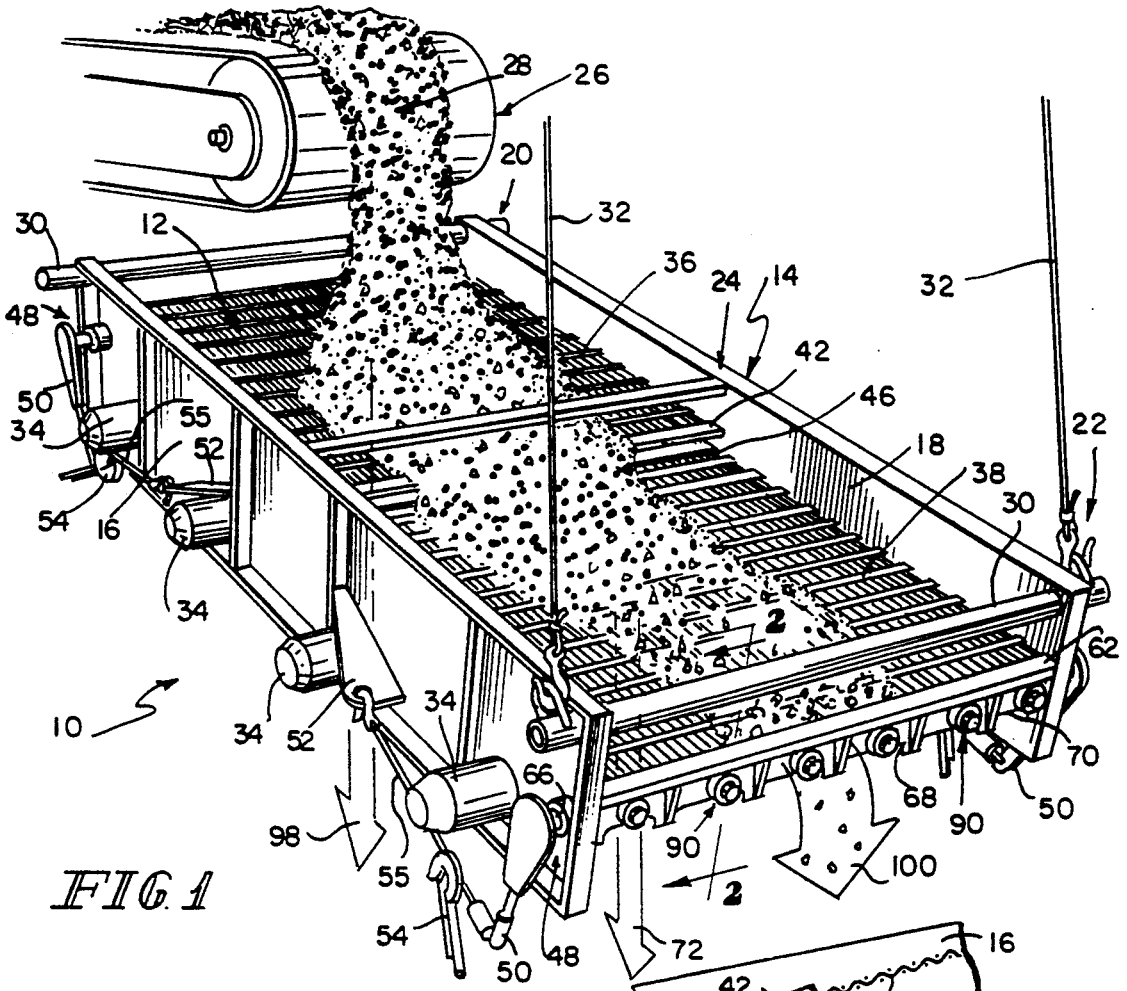
FIG. 1 is a perspective view of a vibrating screen assembly which includes a tension control apparatus of the present invention.

Referring now to the drawings, FIG. 1 illustrates a vibrating screen assembly 10 including a vibrating screen deck 12 mounted within a rigid frame 14. Frame 14 includes spaced apart rigid side walls 16 and 18. Frame 14 includes a first end 20, a second end 22, and a middle section 24. A conveyer assembly 26 located above first end 20 of frame 14 supplies particulate matter 28 to screen deck 12 to separate the particulate matter 28 into different size pieces.

Side walls 16 and 18 are held apart by transverse members (not shown) located beneath the screen deck 12. Side walls 16 and 18 are also held in spaced apart relation by support tubes 30 coupled between side walls 16 and 18 at both the first end 20 and second end 22 of frame 14. Support tube 30 adjacent second end 22 assists in the suspension of frame 14 in an angular position relative to conveyer assembly 26 by suspension cables 32. Suspension cables 32 may be adjusted to change the angle of frame 14 relative to conveyer assembly 26 depending upon the type of particulate matter 28 supplied to vibrating screen assembly 10. Four spaced apart motors 34 rotate shafts which are coupled to eccentric rotating weights which vibrate frame 14. Vibration causes vibratory movement of screen deck 12 and particulate matter 28 so that particulate matter 28 is separated as discussed below.

Figure 2:
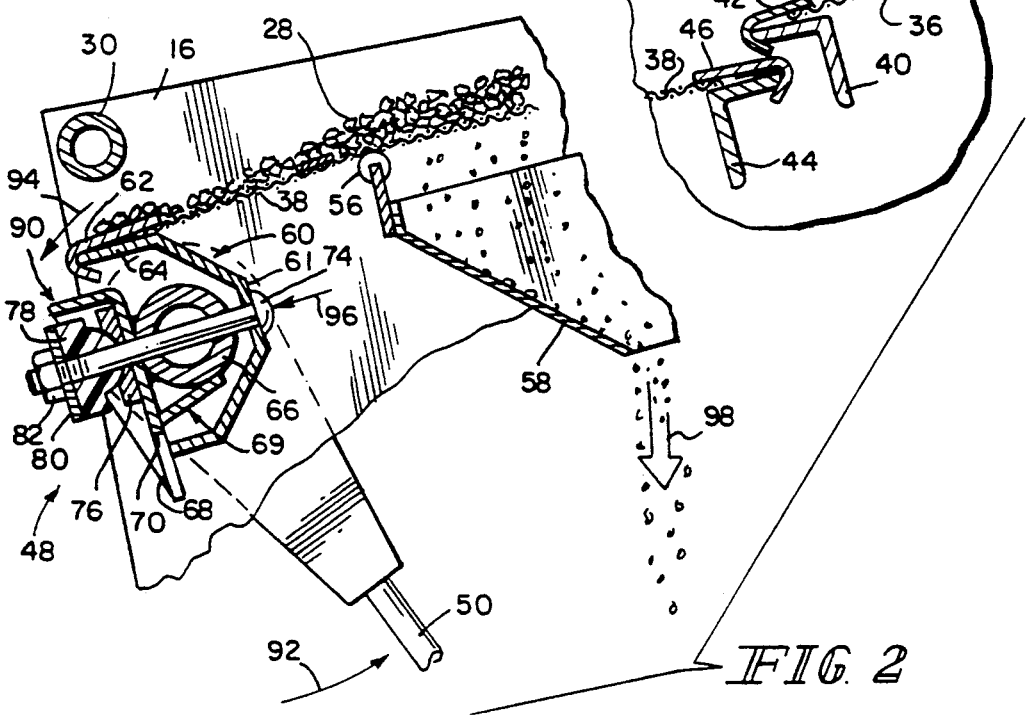
FIG. 2 is a sectional view taken along lines 2—2 of FIG. 1 illustrating the configuration of a rotatable tension plate for adjusting tension of the vibrating screen and an apparatus coupled to the tension plate for selectively and incrementally adjusting the rigidity of the tension plate.

Screen deck 12 includes a first mesh screen 36 located adjacent first end 20 of frame 14 and a second mesh screen 38 located adjacent second end 22 of frame 14. As best illustrated in FIG. 2, a first end of screen 36 is coupled to a rigid angle iron support beam 40 by flange 42. A first end of screen 38 is coupled to a rigid angle iron support beam 44 by flange 46. A coupler plate (not shown) is preferably welded to both support beams 40 and 44. Tension of screens 36 and 38 are controlled by rotatable tension control assemblies 48 located adjacent first end edge 20 and second end edge 22 of frame 14, respectively. Both rotatable tension control assemblies 48 include a tension control lever 50. Tension control levers 50 are coupled to a rigid anchor bracket 52 welded to side walls 16 and 18 of frame 14 by a chain or cable hoist assembly. A ¾ ton rigger 54 is used to adjust the length of chain 55 to rotate levers 50 relative to frame 14, thereby adjusting the tension of screens 36 and 38 as discussed below.

Rotatable tension control assembly 48 is best illustrated in FIG. 2. Because the tension of screens 36 and 38 are adjusted in the same way, only the tension adjustment of screen 38 will be discussed. It is understood that the tension adjustment of screen 36 is performed in the same manner as the tension adjustment of screen 38.

A first end of screen 38 is coupled to rigid angle iron support beam 44 by a flange 46 hooked over support beam 44. Support beams 40 and 44 are rigidly coupled to side walls 16 and 18 of frame 14 and do not move substantially during adjustment of the tension of screens 36 and 38. Screen 38 is positioned over rubber wear strips 56 coupled to vibrating frame 58. A second end of screen 38 is coupled to a tension control plate 60 by flange 62. Specifically, flange 62 coupled to screen 38 is hooked over a top flange 64 of tension plate 60. Tension control assembly 48 includes a pipe 66 coupled to tension control levers 50. A face plate 68 is welded to pipe 66. Dust, grit, sand or other particulate matter may become trapped in a pocket 69 between tension plate 60 and face plate 68. Accumulation of dust, grit, sand or other particulate matter in pocket 69 can prevent movement of tension plate 60 relative to pipe 66 and face plate 68 to adjust the tension of screen 38. To solve this problem, as illustrated in FIGS. 1 and 2, face plate 68 is formed to include a plurality of notches 70 therein to permit particulate matter 28 and accumulated dust which might become lodged between face plate 68 and tension plate 60 in pocket 69 to fall through notches 70 in the direction of arrow 72 in FIG. 1.

Tension plate 60 is coupled to pipe 66 and to face plate 68 by a tension bolts 74 which extend through apertures formed in tension plate 60, through apertures formed on opposite sides of pipe 66, and through apertures formed in face plate 68. A spherical socket 76 is positioned on tension bolt 74 adjacent face plate 68. A rubber tension spring 78 is then positioned on tension bolt 74. In some instances, a steel coil spring can be used instead of rubber tension spring 78. A convex spherical surface of rubber tension spring 78 abuts a concave spherical surface of spherical socket 76. A washer 80 is positioned over tension bolt 74 adjacent to rubber tension spring 78. A lock nut 82 is threadably coupled to the end of bolt 74. Rubber tension springs 78 provide a spring force to bolts 74 to help maintain a constant tension on screen 38 despite stretching of screen 38 which may occur during operation. Convex spherical surface of rubber tension spring 78 swivels to maintain a flush contact with concave surface of spherical socket 76 despite misalignment of the apertures of pipe 66. A flat rubber washer would tend to be skewed or misaligned against face plate 68 if the apertures of tension plate 60 and pipe 66 are misaligned. Therefore, spherical surface of rubber tension spring 78 and spherical socket 76 help provide a uniform force on tension plate 60 to move tension plate 60 relative to pipe 66 and force plate 68 despite some misalignment of the apertures in tension plate 60 and pipe 66.

Figure 3:
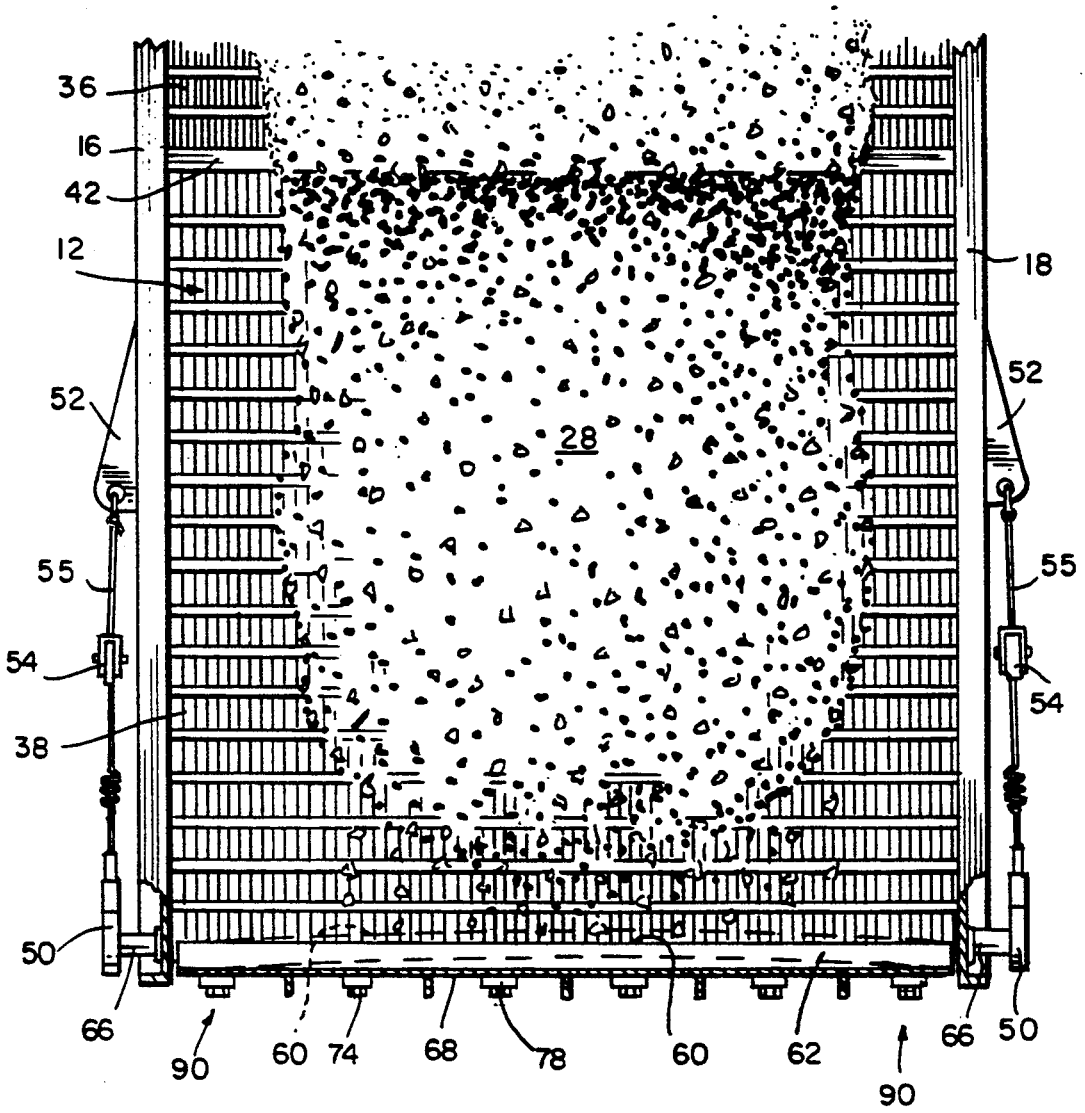
FIG. 3 is a top plan view of the vibrating screen assembly of FIG. 1 illustrating movement of the tension plate during tensioning of the vibrating screen by the adjusting apparatus.

Cooperation of tension bolt 74, pipe 66, face plate 68, spherical socket 76, rubber tension spring 78, washer 80, and lock nut 82 with tension plate 60 provide means for selectively and incrementally adjusting the relative rigidity of tension plate 60 by moving tension plate 60 relative to pipe 66 and face plate 68 to incrementally adjust the tension of screen 38 at predetermined intervals along the width of the screen 38. As illustrated in FIGS. 1 and 3, a plurality of adjustment apparatus 90 are located adjacent to end edge 22 of frame 14. Therefore, the tension of screen 38 can be selectively adjusted over the entire width of screen 38. Tension plate 60 is more flexible than pipe 66 and face plate 68. By securing tension plate 60 to pipe 66 and face plate 68 with adjustment apparatus 90, an operator can effectively make tension plate 60 more or less flexible. In other words, adjustment apparatus 90 adjust the relative flexibility or rigidity of tension plate 60 by forcing tension plate 60 toward pipe 66 and face plate 68 in the direction of arrow 61.

In operation, flange 46 at first end of screen 38 is coupled to angle iron support beam 44. A second flange 62 at second end of screen 38 is then coupled to top flange 64 of tension plate 60. Support beam 44 is rigidly coupled to side walls 16 and 18 of frame 14 and does not move. An operator then adjusts riggers 54 of chain hoists coupled to rotate levers 50 in the direction of arrow 92 in FIG. 2. Levers 50 are coupled to pipe 66. Tension plate 60 is also coupled to pipe 66. Therefore, rotation of levers 50 in the direction of arrow 92 causes rotation of pipe 66 and tension plate 60 in the direction of arrow 94. This causes movement of top flange 64 of tension plate 60 in the direction of arrow 94 to increase the tension on screen 38. As illustrated in FIGS. 1 and 3, tension plate 60 extends across the entire width of frame 14 adjacent end edge 22.

Rotatable tension control assembly 48 facilitates the process of tensioning screen 38. However, a problem that exists with rotatable tension mechanisms is that the tension of screen 38 is often nonuniform across the width of screen 38. In particular, the tension plate 60 can bend to the position illustrated by dotted lines 60 in FIG. 3 as the tension on screen 38 increases. When the tension plate 60 bends as illustrated in FIG. 3, the tension of screen 38 adjacent side walls 16 and 18 of frame 14 is greater than the tension in a center section of the screen 38. Such tension variations can cause problems. If the center section of screen 38 is properly tensioned, the sections of screen 38 adjacent side walls 16 and 18 would be over tensioned. This can cause increased wear on screen 38 in the over tensioned sections. In addition, if the sections of the screen 38 adjacent side walls 16 and 18 are properly tensioned, the center of the screen is under tensioned. This results in decreased efficiency of the vibrating screen assembly 10 in the under tensioned center section of screen 38.

In order to overcome this problem of nonuniform tension of screen 38, the present invention provides a plurality of adjustment apparatus 90 spaced along the width of end edge 22 of frame 14 for selectively and incrementally adjusting the rigidity of tension plate 60. The adjustment apparatus 90 are coupled to the rotating tension plate. This is different from conventional tension control mechanisms. For instance, in U.S. Pat. No. 4,906,352, a second tension control mechanism is provided which is spaced apart from a rotatable tensioning assembly. The apparatus disclosed in the '352 patent includes an adjustable anchor assembly coupled to one end of a screen and a rotatable tension assembly coupled to a second end of the screen spaced apart from the anchor assembly. Rotation of the rotatable tension assembly causes bending of a tension tube. The tension of the screen is nonuniform when the tube is bent. The device in the '352 patent solves this bent tube problem by providing a second tension control mechanism coupled to the anchor assembly spaced apart from the rotatable tension tube. The anchor assembly in the '352 patent is bent by the second tension control mechanism to match the bend of the rotatable tube. The second tension control mechanism illustrated in the '352 patent is accessed at the center of the frame spaced apart from the rotatable tension assembly.

The present invention provides a different and improved solution to the problem of varying tension across the width of screen 38. In the present invention, the adjustment apparatus 90 are located at the same end as the rotatable tension control assembly 48. The adjustment apparatus 90 are spaced along the width of screen 38 to permit incremental adjustment of the position of tension plate 60 relative to pipe 66 and face plate 68. As illustrated in FIGS. 2 and 3, tension plate 60 can be pulled away from pipe 66 when tension control assembly 48 is rotated by rotation of lever 50. By tightening nuts 82, the tension bolts 74 which abut an end wall 61 of tension plate 60 pull or move the tension plate 60 in the direction of arrow 96 to straighten tension plate 60. Adjustment apparatus 90 cause movement of tension control plate 60 from the dotted-line position 60 illustrated in FIG. 3 to the solid-line position 60 illustrated in FIG. 3 so that tension plate 60 is substantially straight and the tension of screen 38 is substantially uniform across the entire width of screen 38.

Particulate matter 28 is supplied to the vibrating screen assembly 10 by conveyor 26. Particulate matter 28 enters vibrating screen assembly 10 adjacent first end 20 of frame 14. Electric motors 34 vibrate screen deck 12. This causes movement of the particulate matter 28 on the surface of screen deck 12. Screens 36 and 38 are formed to include apertures having a predetermined size. Pieces of the particulate matter 28 which are smaller than the size of the apertures in screens 36 and 38 fall through screen deck 12 and hopper 58 in the direction of arrow 98 in FIG. 1. Pieces of the particulate matter which are larger than the size of the apertures in screens 36 and 38 pass over screen deck 12 and fall off second end 22 of vibrating screen assembly 10 in the direction of arrow 100. Therefore, vibrating screen assembly 10 separates particulate matter 28 into various sized pieces. Small pieces of particulate matter 28 fall in the direction of arrow 98 into a first pile while larger pieces of particulate matter are separated into a second pile by falling off the second end edge 22 of vibrating screen assembly 10 in the direction of arrow 100.

From the preceding description of the preferred embodiment, it is evident that the objects of the invention are obtained. Although the invention has been described and illustrated in detail, it is understood that the same is intended by way of illustration and example only and is not to be taken by way of limitation. The spirit and scope of the invention are to be limited only by the terms of the appended claims.

What is claimed is:

1. A vibrating screen apparatus comprising:

a frame;

a screen including a first end, a second end, and a width dimension;

an anchor beam rigidly coupled to the frame;

means for coupling the first end of the screen to the anchor beam;

means for tensioning the screen to substantially a predetermined tension, the tensioning means being rotatably coupled to the frame and spaced apart from the anchor beam to change the tension of the screen upon rotation of the tensioning means relative to the frame;

means for coupling the second end of the screen to the tensioning means; and means for selectively and incrementally adjusting the relative rigidity of the tensioning means at predetermined intervals along the width dimension of the second end of the screen to compensate for nonuniform tension of the screen.

2. The apparatus of claim 1, wherein the frame includes first and second side walls which are spaced apart by a predetermined distance, and wherein the tensioning means includes an elongated pipe rotatably coupled between the first and second side walls of the frame about an axis of rotation, a tension plate coupled to the pipe and to the second end of the screen, and means for rotating the pipe and tension plate about the axis of rotation to move the second end of the screen relative to the frame to adjust the tension of the screen.

3. The apparatus of claim 2, wherein the adjusting means includes means for moving the tension plate relative to the pipe in a direction normal to the axis of rotation of the tension plate to compensate for nonuniform tension of the screen, the moving means being coupled to the tension plate.

4. The apparatus of claim 3, wherein the means for moving the tension plate includes a plurality of adjustable fasteners extending through the tension plate and the pipe at spaced apart intervals to permit adjustment of the position of the tension plate relative to the pipe adjacent each of the plurality of adjustable fasteners.

5. The apparatus of claim 4, wherein each of the plurality of adjustable fasteners includes a bolt extending through the tension plate and the pipe at spaced apart intervals, a rubber tension spring coupled to the bolt, and a nut threadably coupled to the bolt to permit adjustment of the position of the tension plate relative to the pipe.

6. The apparatus of claim 5, wherein each of the plurality of adjustable fasteners also includes a spherical socket coupled to the bolt adjacent the rubber tension spring.

7. The apparatus of claim 6, wherein each spherical socket includes a generally spherical concave surface and each of the rubber tension springs includes a generally spherical convex surface configured to engage the generally spherical concave surface of an adjacent spherical socket.

8. The apparatus of claim 2, wherein means for rotating the pipe and the tension plate includes a lever coupled to the pipe and means for rotating the lever relative to the frame, the means for rotating the lever being coupled between the lever and the frame.

9. The apparatus of claim 2, further comprising a face plate coupled to the pipe opposite the tension plate.

10. The apparatus of claim 9, wherein the face plate is formed to include a plurality of notches.

11. The apparatus of claim 2, wherein the tension plate includes a top flange and wherein a flange coupled to the second end of the screen engages the top flange of the tension plate to couple the second end of the screen to the tension plate.

12. The apparatus of claim 1, wherein the anchor beam is an angle iron beam rigidly coupled to the frame and wherein a flange coupled to the first end of the screen engages the angle iron beam to couple the first end of the screen to the angle iron beam.

13. A vibrating screen apparatus comprising:

a frame;

a screen including a first end and a second end;

an anchor beam rigidly coupled to the frame;

means for coupling the first end of the screen to the anchor beam;

a tension plate rotatably coupled to the frame spaced apart from the anchor beam;

means for coupling the second end of the screen to the tension plate;

means for rotating the tension plate about an axis of rotation to move the second end of the screen relative to the frame to adjust the tension of the screen; and means for moving the tension plate in a direction normal to the axis of rotation of the tension plate to compensate for nonuniform tension of the screen, the moving means being coupled to the tension plate.

14. The apparatus of claim 13, wherein the frame includes first and second side walls which are spaced apart by a predetermined distance, and further comprising an elongated pipe rotatably coupled between the first and second side walls of the frame to define the axis of rotation of the tension plate, the tension plate being coupled to the pipe.

15. The apparatus of claim 14, wherein the means for moving the tension plate includes a plurality of adjustable fasteners extending through the tension plate and the pipe at spaced apart intervals to permit adjustment of the position of the tension plate relative to the pipe adjacent each of the plurality of adjustable fasteners.

16. The apparatus of claim 15, wherein each of the plurality of adjustable fasteners includes a bolt extending through the tension plate and the pipe at spaced apart intervals, a rubber tension spring coupled to the bolt, and a nut threadably coupled to the bolt to permit adjustment of the position of the tension plate relative to the pipe.

17. The apparatus of claim 16, wherein each of the plurality of adjustable fasteners also includes a spherical socket coupled to the bolt adjacent to the rubber tension spring.

18. The apparatus of claim 17, wherein each spherical socket includes a generally spherical concave surface and each of the rubber tension springs includes a generally spherical convex surface configured to engage the generally spherical concave surface of an adjacent spherical socket.

19. The apparatus of claim 14, wherein means for rotating the tension plate includes a lever coupled to the pipe and means for rotating the lever relative to the frame, the means for rotating the lever being coupled between the lever and the frame.

20. The apparatus of claim 14, further comprising a face plate coupled to the pipe opposite the tension plate.

21. The apparatus of claim 20, wherein the face plate is formed to include a plurality of notches.

22. The apparatus of claim 13, wherein the means for moving the tension plate includes a plurality of tension adjusters coupled to the tension plate at spaced apart intervals to permit selective adjustment of the tension of the screen adjacent each of the plurality of tension adjusters.

23. The apparatus of claim 13, wherein the anchor beam is an angle iron beam rigidly coupled to the frame and wherein a flange coupled to the first end of the screen engages the angle iron beam to couple the first end of the screen to the angle iron beam.

24. The apparatus of claim 13, wherein the tension plate includes a top flange and wherein a flange coupled to the second end of the screen engages the top flange of the tension plate to couple the second end of the screen to the tension plate.

* * * * *